US006720919B1

(12) United States Patent
Sinsky et al.

(10) Patent No.: US 6,720,919 B1
(45) Date of Patent: Apr. 13, 2004

(54) PHASED ARRAY CALIBRATION USING SPARSE ARBITRARILY SPACED ROTATING ELECTRIC VECTORS AND A SCALAR MEASUREMENT SYSTEM

(75) Inventors: Jeffrey H. Sinsky, Marlboro, NJ (US); Theodore Sizer, Little Silver, NJ (US); Don Taylor, Toms River, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/247,733

(22) Filed: Sep. 20, 2002

(51) Int. Cl.[7] ..... H01Q 3/22; H01Q 3/24; H01Q 3/26

(52) U.S. Cl. ..... 342/368; 342/174; 342/372

(58) Field of Search ..... 342/368, 174, 342/372, 377

(56) References Cited

U.S. PATENT DOCUMENTS 5,477,229 A * 12/1995 Caille et al. ..... 342/360
5,861,843 A 1/1999 Sorace et al. ..... 342/372
6,144,652 A 11/2000 Avidor et al. ..... 370/336
6,559,799 B2 * 5/2003 Aoyama et al. ..... 342/377

OTHER PUBLICATIONS

Sorace, Ron, "Phased Array Calibration" IEEE Trans. on Antennas and Propagation, vol. 49, Apr. 2001, pp. 517–525.*

Kuehnke, Lutz, "Phased Array Calibration Procedures Based on Measured Element Patterns," International Conf. on Antennas and Propagation, Apr. 2001, pp. 660–663.*

* cited by examiner

*Primary Examiner*—Gregory C. Issing

(57) ABSTRACT

A method, controller, system, and computer program for generating data points by measuring the power of the transmitted/received signal while each antenna element is rotated through a series of phase angles. Thereafter, a pairwise comparison of these data points is performed in order to determine the phase and amplitude corrections needed for each antenna element. This pairwise analysis uses as few as three signal measurements for each antenna element, made at sparse, arbitrarily spaced phase angles. Further, the method includes smart data selection to ignore bad data points resulting from anomalies or noise bursts.

29 Claims, 6 Drawing Sheets

PHASED ARRAY CALIBRATION USING SPARSE ARBITRARILY SPACED ROTATING ELECTRIC VECTORS AND A SCALAR MEASUREMENT SYSTEM

TECHNICAL FIELD

The present invention relates to the field of phased array antenna calibration, and in particular, the calibration of phase and amplitude of the base band signals of the array antenna elements.

BACKGROUND ART

Conventional phased array antennae include antenna elements, phase shifters, and attenuator electronics, as well as other elements. The parameters of phase shifters and attenuator electronics vary with temperature and drift with time. As a result, periodic calibration of the phased array antenna is performed to determine phase and amplitude corrections for each antenna element. The present state of the art in the field of phased array calibration includes two techniques. The first technique uses many data points so that phase rotation of the rotating vector yields the location of the maximum or minimum of the signal intensity, and thus the location of the antenna element phase offset. A drawback of this first technique is that many data points must be processed.

A second technique, described in U.S. Pat. No. 5,861,843, uses four specific orthogonal phase states (0, 90, 180, 270 degrees) to perform phased array calibration. A drawback of this second technique is that the calibration measurements must be made at precisely these four orthogonal angles.

SUMMARY OF THE INVENTION

In accordance with the principles of the invention, an antenna element of a transmit phased array antenna may be calibrated by first applying a signal having a defined amplitude and phase to each antenna element; maintaining the phase and amplitude of the transmit signal applied to an arbitrarily selected reference element, rotating the transmit phase of the antenna element being calibrated through a sequence of known phase steps while keeping the transmit phase of each of the other antenna elements constant, combining each of the signals from each of the antenna elements at each known phase step of the sequence with corresponding signals from the arbitrarily selected reference element in pairwise fashion to produce a plurality of combined signals, and measuring the combined signals. Thereafter, a phase error and amplitude error for each of the plurality antenna elements is determined based on the plurality of combined signals corresponding to the sequence of known phase steps.

The method of the present invention provides at least two advantages over the prior art. The first advantage is the ability to calibrate the array using sparse, arbitrarily spaced phase angles. For example, the phase states need not be fixed at (0, 90, 180, 270) as in the prior art, but rather may be four points evenly spaced but not these specific, orthogonal states, for example (10, 100, 190, 280). Alternatively, the phase states may be arbitrary and non-uniformly spaced, for example, (10, 90, 190, 300).

The second advantage is the ability to calibrate an antenna element with as few as three phase measurements. For example, the three phase states may be specific and uniformly spaced, for example, (0, 120, 240), they may be arbitrary and uniformly spaced, for example (10, 130, 250) or they may be arbitrary and non-uniformly spaced, for example, (10, 120, 250).

In summary, the method of the present invention permits as few as three point to be used. Further, these three points need not be uniformly spaced or spaced based on an initial phase state of 0 or any other value.

Advantageously, an antenna system may be calibrated more rapidly (than was possible using prior art techniques.) Additionally, calibration may be achieved using a partially corrupt data set by ignoring bad data points by employing smart data selection to ignore obviously corrupt data points.

DETAILED DESCRIPTION OF THE PREFERRED EMBODIMENTS

Figure 1A:
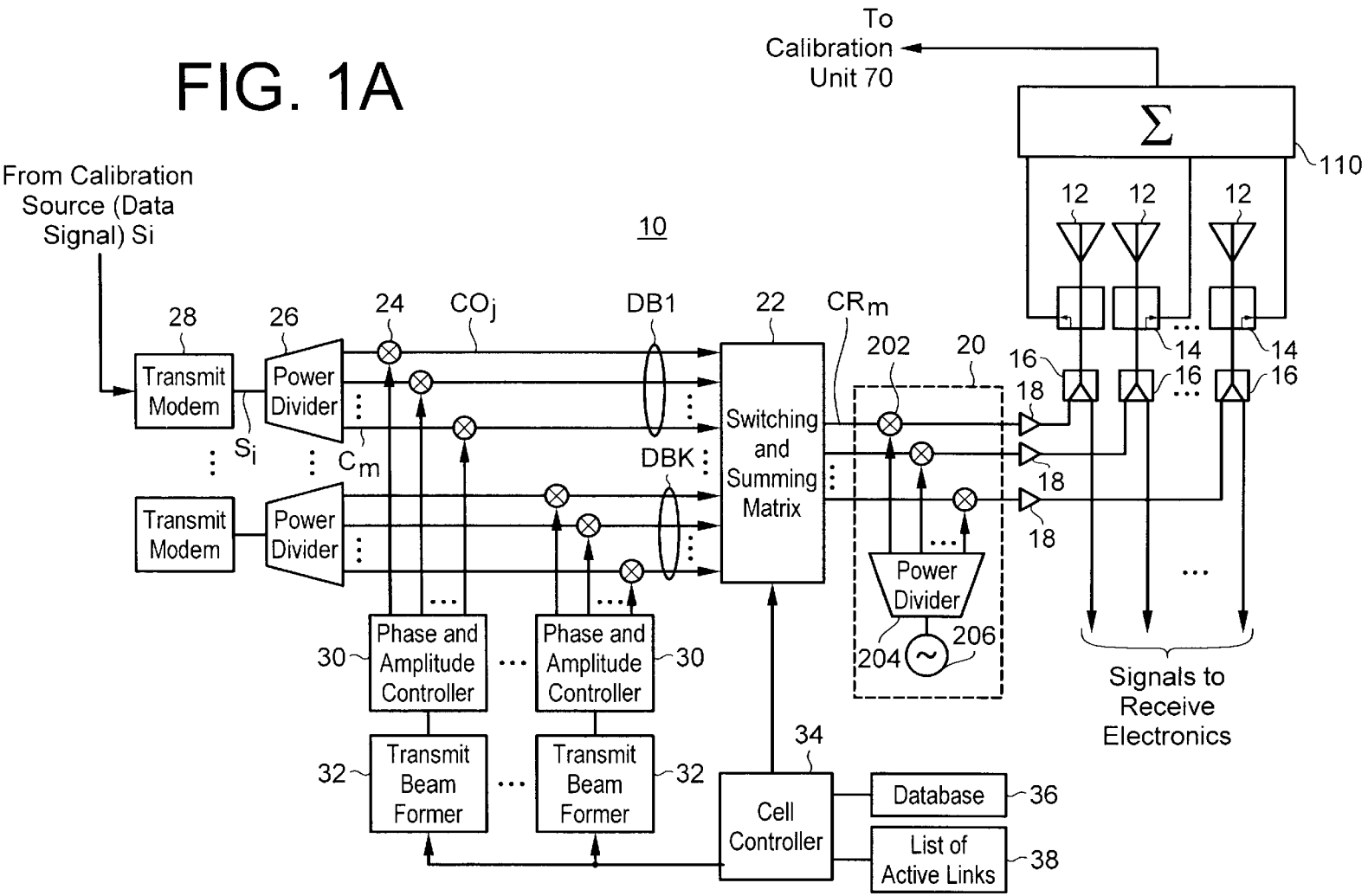
FIG. 1A illustrates a phased array antenna in a transmit system according to an exemplary embodiment of the present invention.
Figure 1B:
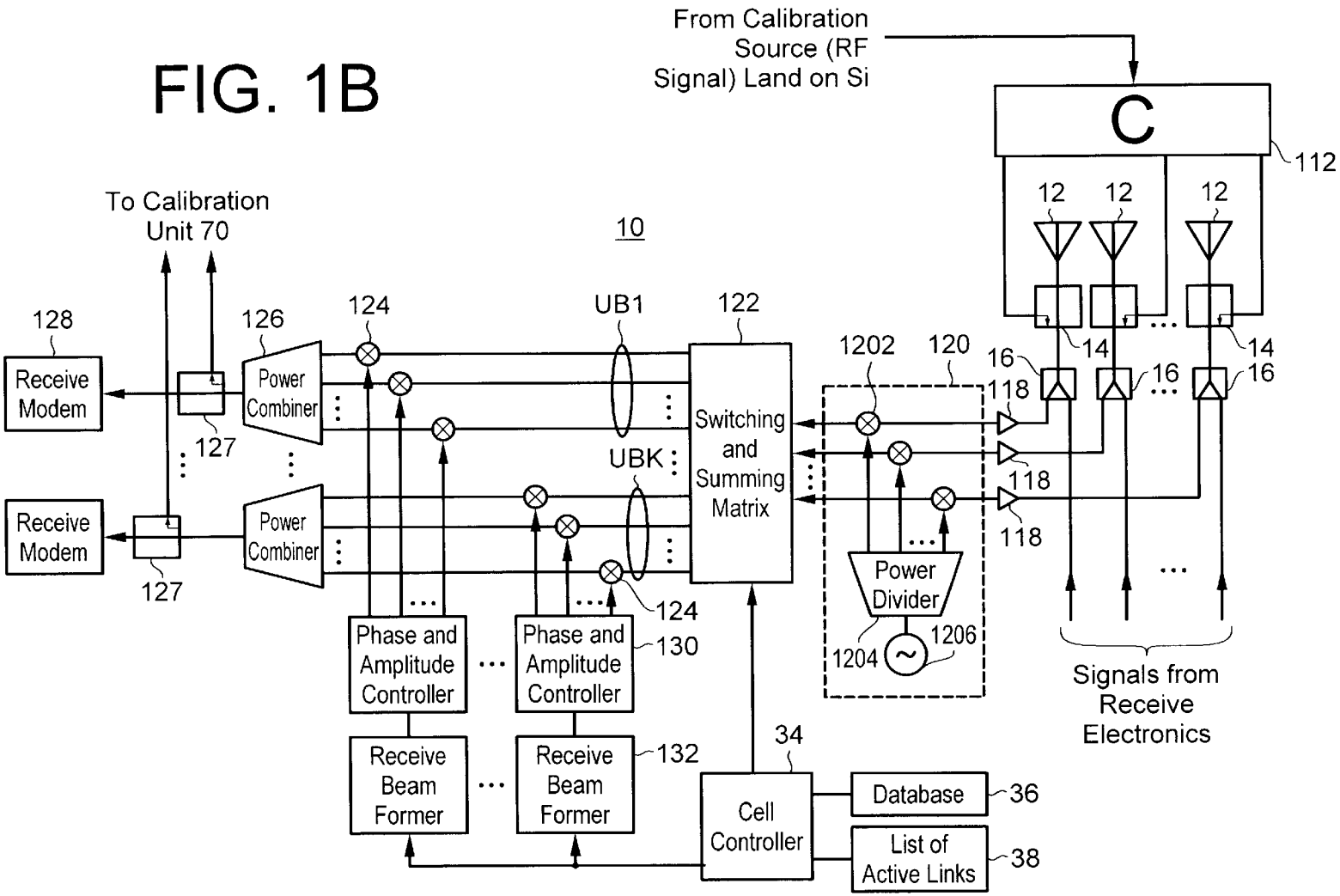
FIG. 1B illustrates a phased array antenna in a receive system in an exemplary embodiment of the present invention.

FIGS. 1A and 1B each illustrate an exemplary phased array antenna 10, which includes a plurality of antenna elements 12. Each antenna element 12 may transmit and receive electromagnetic signals such as radio frequency (RF) signals.

FIG. 1A illustrates a block diagram of the phased array antenna 10 used in a transmit system. A number K of transmit modems 28 provide a data transmission signal $S_i=_{l-K}$, where K is the number of transmit beams DB1–DBN. These K transmit signals are distributed across M phased array antennas 10 contained within a base station. In the exemplary embodiment, one phased array antenna 10 may be used to transmit each of the K signals simultaneously. Each signal $S_i$ is sent to a connected power divider 26, which divides the signal $S_i$ into M channels $C_1$–$C_M$. In at least one exemplary embodiment, $M \neq K$.

Each channel $C_m$ is sent from the power divider 26 to one of M multipliers 24, where it is multiplied by an appropriate one of M sine waves generated by a phase and amplitude controller 30. Each sine wave has an amplitude and phase determined by a component of a weighting vector W, which is calculated by one of the transmit beam formers 32 controlled by cell controller 34. The M channels $CO_j$ output from each multiplier 24 are sent to a switching and summing matrix 22, which is also under the control of cell controller 34. The switching and summing matrix 22 routes each group of M channels $CO_1$–$CO_m$ into M contiguous, and possibly overlapping, radiator channels $CR_1$–$CO_m$, which are connected to an up-converter 20. The up-converter 20 includes a bank of mixers 202,a power divider 204, and a common local oscillator (synthesizer) 206. The up-converter 20 up-converts each radiator channel $CR_j$ to the transmission frequency.

Each of the M up-converted radiator channel $CR_j$ is fed to a power amplifier 18 and sent to a corresponding diplexer 16. Each diplexer 16 is connected to a passive and reciprocal component, directional coupler 14. The directional coupler 14 routes the amplified signal to both an antenna element 12 and a passive power summing unit 110. The power summing unit 110 acts as a voltage summing node, which outputs the summed voltages of the M channels to a calibration unit illustrated in FIG. 4 discussed below in more detail.

FIG. 1B illustrates a block diagram of exemplary phased array antenna used in a receive system. Signals received by the array antenna elements 12 are sent via directional couplers 14 to diplexers 16. Alternatively, calibration signals sent directly to power splitter 112 may be split M ways and forwarded to the directional couplers 14. The outputs of the directional couplers 14 are routed to a bank of low noise amplifiers 118 via diplexers 16. The amplified signals are then passed to a down-converter 120. Similar to the up-converter 20 of FIG. 1A, the down-converter 120 contains a set of M mixers 1202, a power divider 1204, and a common local synthesizer 1206. The received signals are down-converted to a frequency for processing in the switching and dividing matrix 122.

Under control of the cell controller 34, the switching and dividing matrix 122 routes the signals from the group of M contiguous antenna elements 12 to the appropriate one of uplink beam channels UB1–UBK. At one of the K sets of M multipliers 124, each of the routed signals are multiplied by an appropriate one of M sine waves, which are generated by one of the K phase and amplitude controllers 130. The phase and amplitude of each sine wave is determined according to a component of weighting vector W that is determined by the receive beam formers 132 under the control of cell controller 34.

The M multiplied signals on the uplink channel UB1–UBK are sent to power combiner 126, and the combined signal is fed to directional couplers 127, which routes the signal to a receive modem 128 and the calibration unit (not specifically shown).

Figure 2:
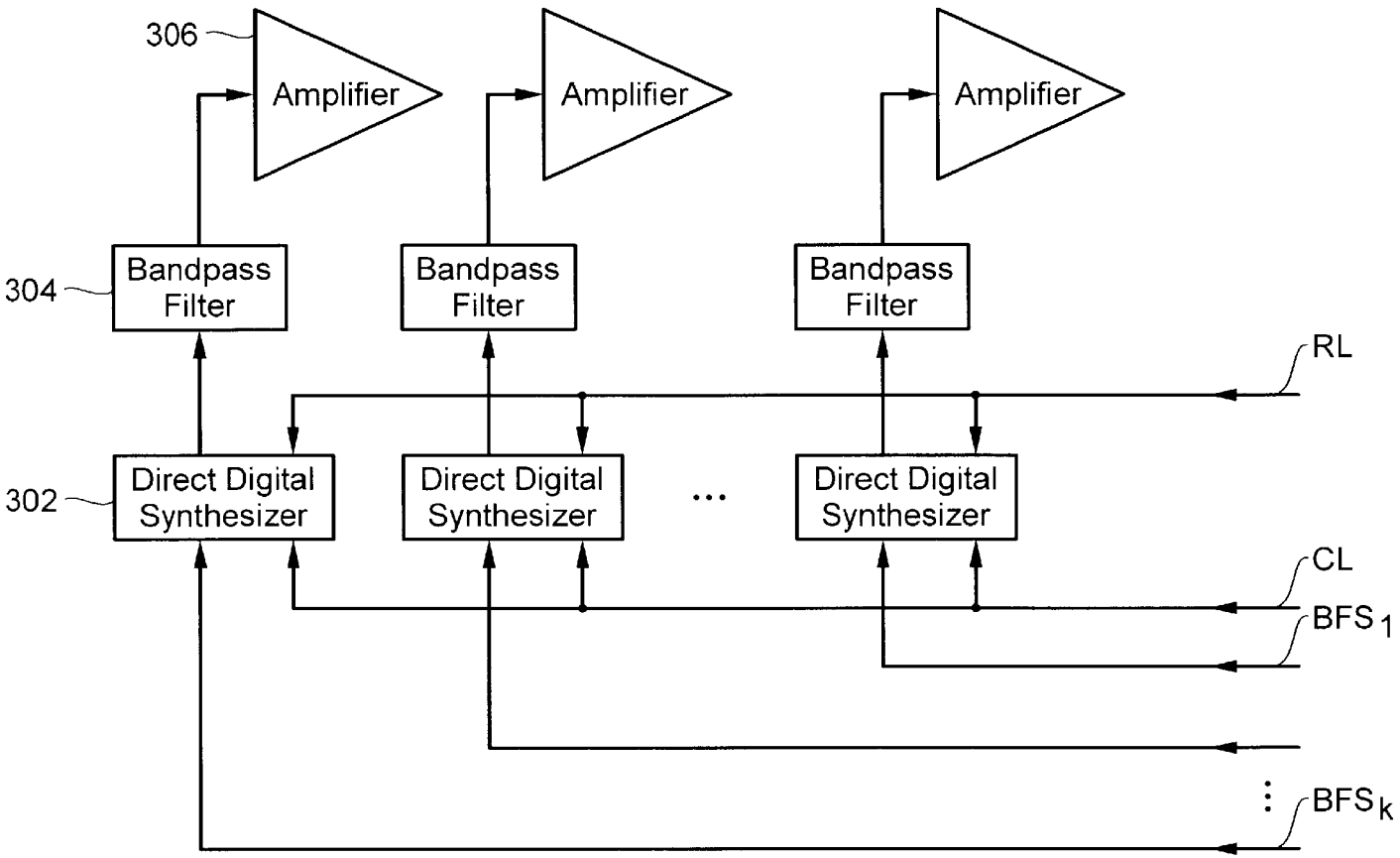
FIG. 2 illustrates the configuration of the phase and amplitude controllers in an exemplary embodiment of the present invention.

FIG. 2 illustrates a block diagram of the phase and amplitude controllers 30, 130 in an exemplary embodiment of the present invention. A phase and amplitude controller 30, 130 contains M direct digital synthesizers (DDSs) 302. Each DDS 302 generates a sine wave whose phase and amplitude is determined according to one of M control signals $BFS_1$ . . . $BFS_M$ which is generated by the corresponding transmit or receive beam former 32, 132. The entire set of DDSs 302 is clocked by the common clock line CL, and reset according to the common reset line RL. The signal outputs from the DDSs 302 are sent to bandpass filters 304 to filter out undesired noise. The filtered signals are amplified by amplifiers 306.

The phase and amplitude of each signal fed into or received by an antenna element 12 are used to form a beam in a certain direction. Accurate pointing of a beam of a phased array antenna therefore depends on the precision with which the phase and amplitude of the signal is controlled. As a result, knowledge of the exact phase and gain response of the components of each phase and amplitude controller 30, 130 is useful for ensuring accurate beam direction. However, due to temperature and drift, the parameters of these components may vary with time. Periodic calibration is therefore required for the phase and amplitude controller 30, 130 corresponding to each antenna element signal.

Figure 3:
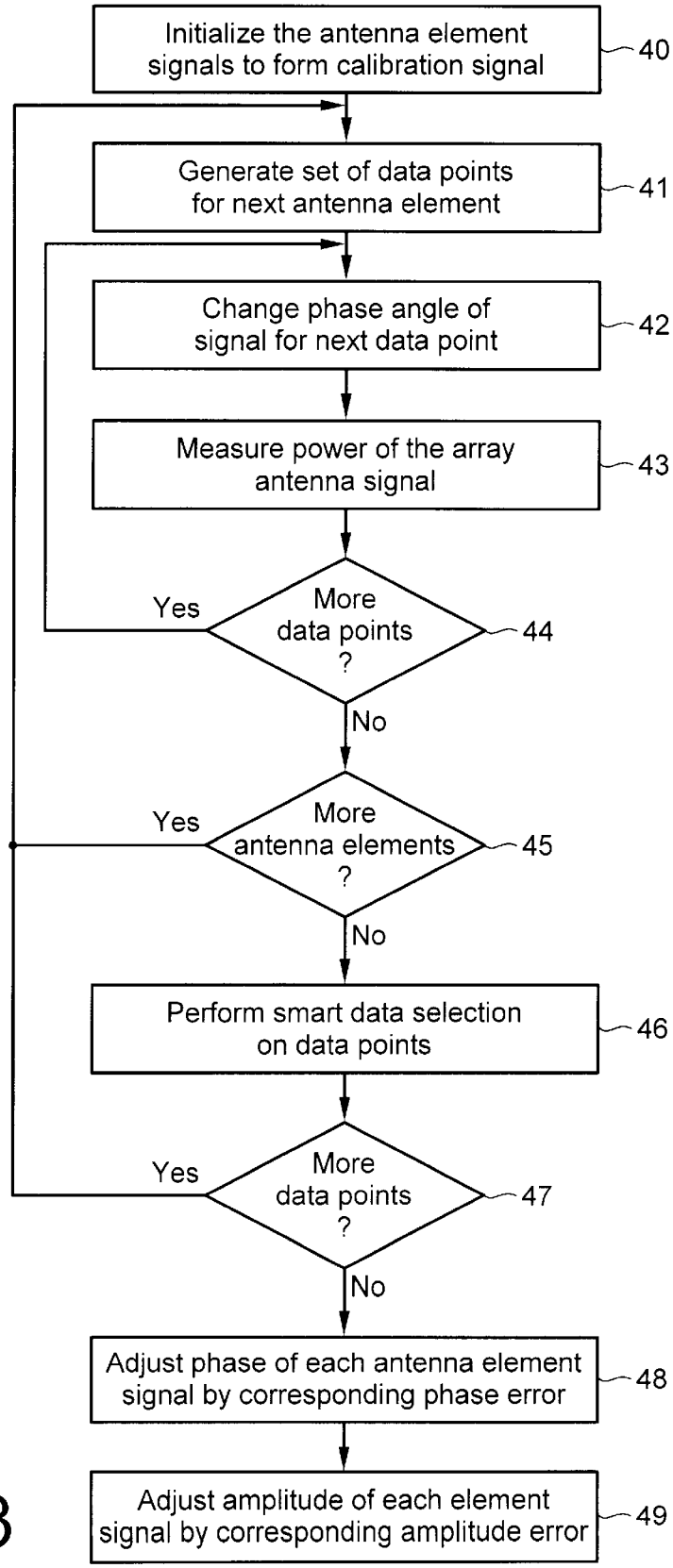
FIG. 3 illustrates a flowchart in one exemplary embodiment of the present invention.

FIG. 3 includes a flowchart 400 illustrating the procedure for calibrating the phase and amplitude controller 30, 130 of each antenna element 12 according to an exemplary embodiment of the present invention. In step 40, the phased array antenna 10 is configured to form a test beam by initializing the phase and amplitudes corresponding to each antenna element 12. Thereafter, one may use the previous calibration state of the antenna as an "initial state" if the calibration has been carried out previously. When the phased array antenna 10 is initialized, the phase of the DDS signal for each antenna element 12 is regarded as having a phase value of 0°, even though the actual phase values of the antenna elements 12 will typically differ. In this initialized position, the amplitudes of the test signals for antenna elements 12 are typically close but not identical; therefore, the amplitudes of each of the phase and amplitude controllers 30, 130 are set at the same level.

To generate a set of data points for each antenna element signal, the sequence of steps 41–45 is performed. Step 41 initiates this sequence of steps for the next antenna element signal. In step 42, a new data point for the antenna element signal is generated by adjusting its phase, while keeping the phase and amplitude of the other antenna elements signals constant. The phase of the antenna element signal is adjusted by changing the phase of the corresponding DDS signal in the phase and amplitude controller 30, 130. The power of the transmitted/received signal is then measured and recorded for the data point in step 43.

Thus, when a data point is being measured for a particular antenna element 12, it is only necessary to know the difference between the initialized phase value and the set phase value of the current measurement (i.e., the known DDS phase step). Thus, a DDS 302 is particularly advantageous for use in generating the antenna element signal, because of the precision with which the phase of a DDS signal can be adjusted.

In step 44, a determination is made as to whether more data points are required for calibrating the antenna element 12. According to an exemplary embodiment of the present invention, an antenna element signal may be calibrated with as few as three separate data points. However, more data points may be collected in order to provide a more accurate calibration of the antenna elements 12. After the requisite number of data points has been generated, decision block 45 determines whether there are any more antenna elements 12 within the phased array antenna requiring data point measurements. If so, the procedure returns to step 41 to generate data points for the next antenna element signal.

Anomalies and noise bursts may cause some of the data points to become corrupted. In an exemplary embodiment, a smart data selection algorithm is performed (step 46), in order to detect and discard obviously corrupt data points. Any such algorithms for detecting irregular or inconsistent data values from a series of measurements may be used in this step, as will be contemplated by those ordinarily skilled in the art.

After smart data selection has filtered out the corrupt data points, step 47 determines whether there are still a sufficient number of data points (at least 3) for each antenna element 12. If not, the process returns to step 41 to generate additional data points.

In step 48, a phase error is calculated for each antenna element 12. Accordingly, each phase and amplitude controller 30, 130 adjusts the phase value of its associated antenna element signal by the determined amount of phase error. In particular, control signal $BSF_J$ is used to change the phase of the wave signal generated by the $j^{th}$ DDS 302 in the corresponding phase and amplitude controller 30, 130.

The amplitude error for each antenna element 12 is calculated in step 49. The phase and amplitude controllers 30, 130 adjust the amplitude of each antenna element signal by the amount of amplitude error calculated for the corresponding antenna element 12. Specifically, the $BSF_J$ signal changes the amplitude of the signal output by the $j^{th}$ DDS 302 of each phase and amplitude controller 30, 130. A detailed description of the method for determining the phase and amplitude errors in an exemplary embodiment is given below.

The RF signal sent to the calibration unit, either from a transmit or receive antenna system 10, can be expressed as the sum of two sinusoids:

$$S_{rf}(t)=b[\cos(\omega t+\phi)+a\cos(\omega t+\phi+e+\Delta)] \tag{1.1}$$

where $\phi$ is an arbitrary offset angle;

e is the phase error between the two sine waves;

$\Delta$ is the synthesized phase step of a DDS; and a, $b \geqq 0$.

In an exemplary embodiment, the calibration model of the present invention uses a scalar system that uses a pairwise comparison of signals to determine relative phase and amplitude of the signals. It is noted that the variable a and b in Equation 1.1 can be assumed positive without any loss of generality. In other words, any pair of sinusoids can be expressed with this model.

Figure 4:
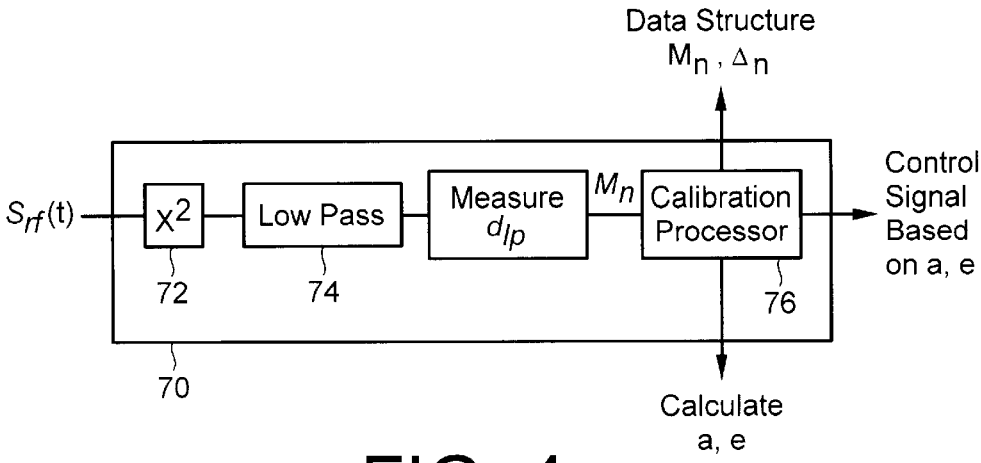
FIG. 4 illustrates a functional block diagram of the receiving circuitry of the calibration unit in an exemplary embodiment of the present invention.

FIG. 4 functionally illustrates the effect of sending the signal $S_{rf}(t)$ to the calibration unit 70. The calibration unit 70 measures the power amplitude of the signal $S_{rf}(t)$ by passing it through a square law power detector 72 and low pass filter 74.This processing results in an output signal, $d_{lp}$, which is processed by a calibration processor 76. Output signal $d_{lp}$ may be defined as $$d_{lp}=\frac{b^2}{2}+\frac{a^2b^2}{2}+ab^2\cos(\Delta+e) \tag{1.2}$$

where the constants are defined in Equation (1.1). Equation (1.2) can be rewritten as $$d_{lp}=\frac{b^2}{2}+\frac{a^2b^2}{2}+ab^2\cos\Delta\cos e-ab^2\sin\Delta\sin e$$

where $$e_Q \equiv a\sin e$$

$$e_I \equiv a\cos e$$

$$\text{and thus } a^2=e_Q^2+e_I^2 \tag{1.4}$$

and substituting Equation (1.4) into Equation (1.3), results in $$d_{lp}=\frac{b^2}{2}+\frac{e_Q^2+e_I^2}{2}b^2+e_Ib^2\cos\Delta-e_Qb^2\sin\Delta \tag{1.5}$$

Solving for the constants in Equation (1.4), Equation (1.5) can be rewritten by defining $$\xi \equiv \frac{b^2}{2}+\frac{e_Q^2+e_I^2}{2}b^2 \tag{1.6}$$

$$c_1 \equiv e_Ib^2$$

$$s_1 \equiv -e_Qb^2$$

and therefore Equation (1.5) becomes $$d_{lp}=\xi+c_1\cos\Delta+s_1\sin\Delta \tag{1.7}$$

Expressing Equation (1.7) in terms of a series of measurements, produces the following matrix expression $$\begin{pmatrix} m_1 \\ m_2 \\ \vdots \\ m_N \end{pmatrix}=\begin{pmatrix} \cos\Delta_1 & 1 & \sin\Delta_1 \\ \cos\Delta_2 & 1 & \sin\Delta_2 \\ \vdots & \vdots & \vdots \\ \cos\Delta_N & 1 & \sin\Delta_N \end{pmatrix}\cdot\begin{pmatrix} c_1 \\ \xi \\ s_1 \end{pmatrix} \tag{1.8}$$

where $\Delta_q$=known (set) relative DDS phase values $m_q$=measured values of $d_{1p}$.

In matrix form, Equation (1.8) can be seen to be a problem of a general least squares fit. Including the effects of noise, Equation (1.8) can be thought of as $$y=H\cdot\hat{\theta}+n \tag{1.9}$$

This can be solved simply using the general least squares fit such that $\theta$ can be represented by $$\hat{\theta}=(H^T\cdot H)^{-1}\cdot H^Ty \tag{1.10}$$

Solving for $c_1$ and $s_1$ and defining their estimates as $\hat{c}_1$ and $\hat{s}_1$, gives $$\hat{c}_1=ab^2\cos e$$

$$\hat{s}_1=-ab^2\sin e \tag{1.11}$$

Figure 5:
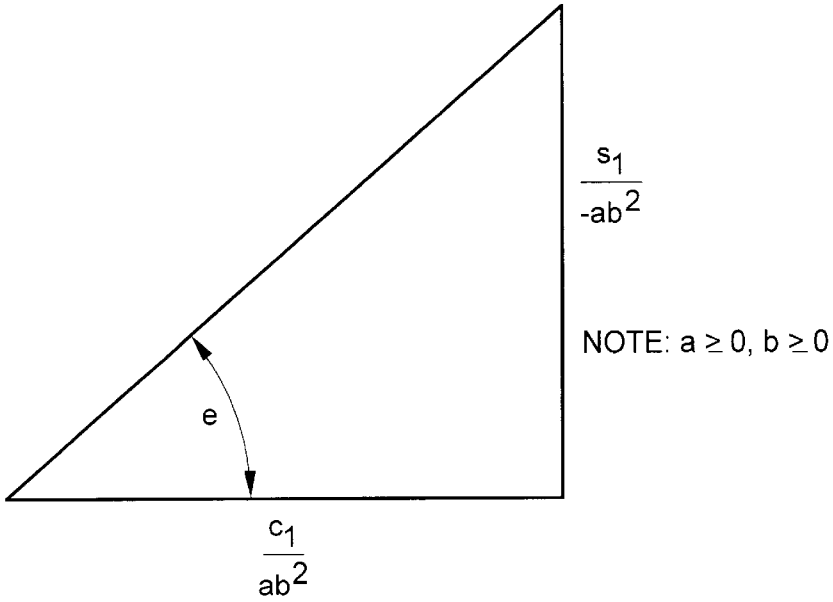
FIG. 5 illustrates an angle solution geometry in an exemplary embodiment of the present invention.

Using the geometry illustrated in FIG. 5, results in $$e=\arctan(-\hat{s}_1,\hat{c}_1) \tag{1.12}$$

Defining the angle estimate for e as $\hat{e}$, the expression for the low pass detected output $d_{lp}$ may be rewritten as $$d_{lp}=\frac{b^2}{2}(1+a^2+ab^2\cos(\Delta+\hat{e})) \tag{1.13}$$

Regrouping terms, Equation (1.13) can be rewritten as $$d_{lp}=k_1+k_2\cos(\Delta+\hat{e}) \tag{1.15}$$

where $$k_1 \equiv \frac{b^2}{2}(1+a^2)$$

$$k_2 \equiv ab^2$$

The same group of measurements may then be used to carry out at least squares fit for $k_1$ and $k_2$ in Equation (1.14) as follows:

$$\begin{pmatrix} m_1 \\ m_2 \\ \vdots \\ m_N \end{pmatrix} = \begin{pmatrix} 1 & \cos(\Delta_1+\hat{e}) \\ 1 & \cos(\Delta_2+\hat{e}) \\ \vdots & \vdots \\ 1 & \cos(\Delta_N+\hat{e}) \end{pmatrix} \cdot \begin{pmatrix} k_1 \\ k_2 \end{pmatrix} \tag{1.15}$$

where $\Delta q$=known relative DDS phase values $m_q$=measured values of $d_{lp}$.

As set forth before, Equations (1.9) and (1.10) define the least squares estimates for $k_1$ and $k_2$ which will be defined as $\hat{k}_1$ and $\hat{k}_2$. Solving the following two equations for a and b gives $$\hat{k}_1 = \frac{b^2}{2}(1+a^2) \qquad \hat{k}_2 = ab^2 \tag{1.16}$$

Solving the second part of Equation (1.16) for $b^2$ and substituting into the first part of Equation (1.16), produces a quadratic equation in a which is as follows:

$$0 = a^2 - 2\frac{k_1}{k_2}a + 1 \tag{1.17}$$

Solving (1.17) for a, gives $$a_{1,2} = \frac{k_1}{k_2} \pm \sqrt{\left(\frac{k_1}{k_2}\right)^2 - 1} \tag{1.18}$$

If $k_1 > k_2$ then the radical in Equation (1.18) is real and thus two real solutions exist for a. It is noted that the variable a is the ratio of the element's amplitude at the relative phase to that of a stationary element's amplitude. The stationary sinusoid can be the composite vector formed by summing all but the rotating vector.

When the stationary vector is assumed to be the composite of many sinusoids (e.g., in the prior art REV technique), it will be known with relative certainty that a<1. This is significant because simple algebra show that $$a_1 \cdot a_2 = 1 \tag{1.19}$$

Therefore, in the REV technique, there exists a single solution for a, specifically the value, either $a_1$ or $a_2$ that is less than 1.

However, in the pair wise calibration approach of the present invention, it must first be determined whether the reference power (known amplitude at which each antenna element is set) is greater than or less than the signal of the element being calibrated. If the reference power is greater than the calibrated element's signal, the value of a is the solution less than one. If not, the value of a is the solution greater than one.

A control signal based on a and e is then sent to the beamformer. As a result of the determination of a and e as set forth above, it is not necessary to adjust the phase of each antenna element to values that are orthogonal or uniformly spaced with respect to each other.

For example, the phase states need not be fixed at (0, 90, 180, 270) as in the prior art, but rather may be four points evenly spaced but not these specific, orthogonal states, for example (10, 100, 190, 280). Alternatively, the phase states may be arbitrary and non-uniformly spaced, for example, (10, 90, 190, 300).

The second advantage is the ability to calibrate an antenna element with as few as three phase measurements. For example, the three phase states may be specific and uniformly spaced, for example, (0, 120, 240), they may be arbitrary and uniformly spaced, for example (10, 130, 250) or they may be arbitrary and non-uniformly spaced, for example, (10, 120, 250).

In summary, the method of the present invention permits as few as three point to be used. Further, these three points need not be uniformly spaced or spaced based on an initial phase state of 0 or any other value.

The calibration technique described above is intended for use with both the transmit and receive antenna systems 10 illustrated in FIGS. 1A and 1B, respectively. In both cases, a specific sequence of RF signals (calibration signals) is transmitted from the antenna 10 to the calibration unit 70. The calibration unit 70 may be configured as a simple computing platform to process and detect the amplitude of the transmitted signal in order to determine the relative phase and amplitude of the array elements 12, thereby generating a data point. A detailed description of this process is given below.

In the phased array antenna 10 in transmit mode, as illustrated in FIG. 1A, each calibration signal originates as a data transmission signal $S_i$ which is communicated from a calibration source to a transmit modem 28. The calibration signal $S_i$ is then divided into the M channels $C_1 \ldots C_M$ each of which is mixed with a DDS signal output by the phase and amplitude controller 30.

For each antenna element 12, the transmit beamformer 32 sets the phase and amplitude of the corresponding DDS 302 to known values. For example, when a data point is being generated for a specific antenna element, the corresponding DDS 302 is set to a relative known phase of $\Delta_q$ while the phases of the other values are set at their initialized values (assumed to be 0°). The above discussion with respect to FIG. 3 specifically describes how the phases and amplitudes are determined for the data points.

After the calibration signal is processed by the switching and summing matrix 22, up-converter 20, and power amplifiers 18, the resultant signal is sent to the bank of M directional couplers 14, each corresponding to a specific antenna element 12. The directional couplers 14 route the M components of the calibration signal to the power summer 110, where they are summed and output to the calibration unit 70. The calibration unit 70 measures the power amplitude of the signal transmitted from the power summer 110, and stores this value along with the known relative DDS phase value $\Delta_q$ as a data point. According to an exemplary embodiment, the calibration processor 76 stores each data point in a data structure (e.g., database) residing on a data storage device connected to the calibration unit 70. Alternatively, calibration processor 76 may store these values in a data storage device external to the calibration unit 70.

To generate a data point for the receive phased array antenna system 10 of FIG. 1B, the calibration signal is first received from the calibration source at power splitter 112. The signal is split and sent to the M directional couplers 14, which direct the signal through the amplifiers 118 to the down-converter 120. The down-converted signal is processed by the switching and summing matrix 122 and output to mixers 124. The phase and amplitude of each of the K channels of the calibration signal is determined by the DDS signals output by the phase and amplitude controller 130 controlled by cell controller 34.

The resultant signals are combined into a single signal at power combiner 126, which is sent to the calibration unit 70 by directional coupler 127. The calibration unit 70 detects the amplitude of the combined signal, and stores the corresponding data point in a data storage device for each received channel.

In an exemplary embodiment, after collecting a number of data points, the calibration processor 76 may filter out the data points according to the smart data selection, and then execute the pairwise calibration analysis of the present invention the data points to determine the phase and amplitude error of each antenna element 12. The calibration processor 76 may then cause a control signal to be transmitted to the phased array antenna 10, for instructing the receiver beamformer 132 to adjust the phase and amplitude of the DDS signal corresponding to each antenna element 12. The phase and amplitude of each DDS 302 is adjusted by the amount of the calculated phase and amplitude error, respectively.

In an alternative embodiment, the functions of the calibration processor 76 may be distributed among a plurality of processing units, either internal or external to the calibration unit 70. For example, separate processing devices may be configured for performing smart data selection on the stored data points, and for processing the data points to determine the phase and amplitude errors of each antenna element 12.

Figure 6:
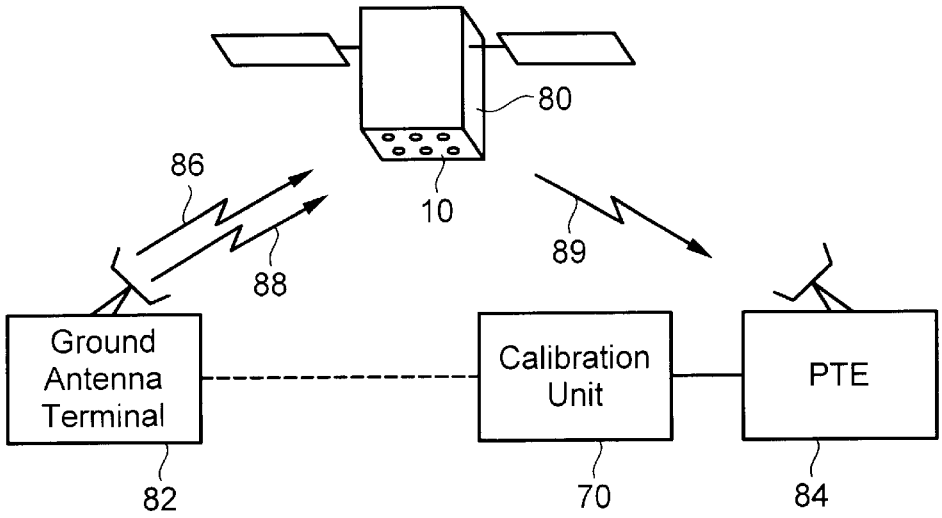
FIG. 6 illustrates a configuration for transmit calibration of a satellite-based phased array antenna system in an exemplary embodiment of the present invention.
Figure 7:
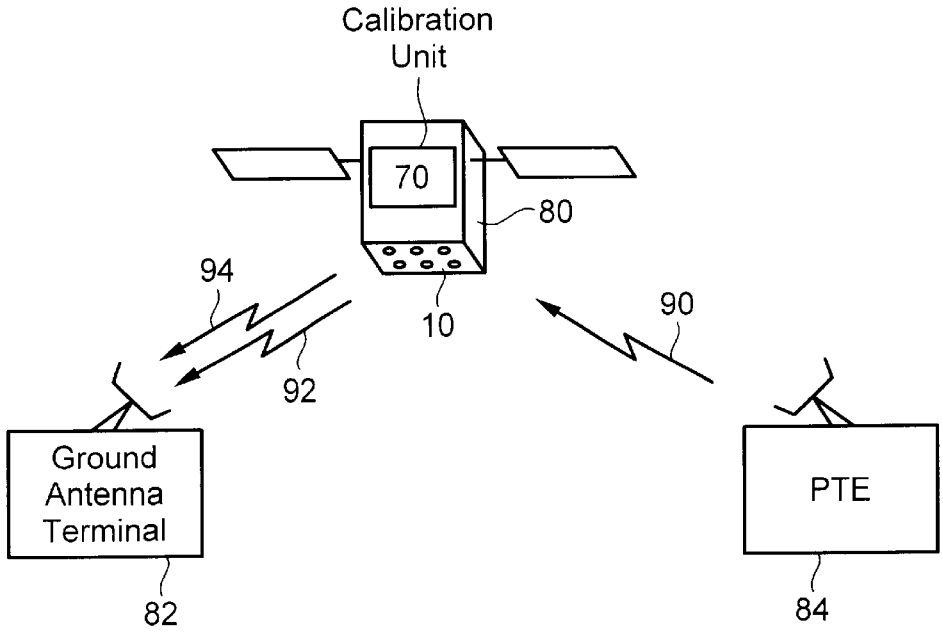
FIG. 7 illustrates a configuration for receive calibration of a satellite-based phased array antenna system in an exemplary embodiment of the present invention.

While the above description discloses that the calibration signals are collected from the antenna system 10 using directional couplers 14, 127, the calibration signals may alternatively be transmitted to the calibration unit 70 via antenna elements 12. FIGS. 6 and 7 illustrate such an exemplary embodiment, in which the present invention is used to calibrate a phased array antenna 10 disposed in a satellite 80.

FIG. 6 specifically illustrates an embodiment where the antenna 10 operating in transmit mode is being calibrated. A ground antenna terminal 82 may transmit a calibration command 86 to the satellite. In response, a sequence of calibration signals $S_i$ is generated, for example, by one or more Application-Specific Integrated Circuits (ASICs) within the satellite 80. During this sequence, the ASICs instruct a controller (for example, a satellite-based system controller equivalent to the beamformer 32 and 132 of FIGS. 1A and 1B) to control the phase and amplitude of the DDS signals output by the phase and amplitude controllers 30.

The configuration and operation of phased array antenna 10 of FIG. 6 is similar to that of FIG. 1A, except that the directional couplers 16 and power summer 110 may be excluded. Each processed calibration signal is routed from the power amplifiers 18 directly to the antenna elements 12. The signals are then sent to a performance test equipment (PTE) terminal 84 via downlink transmission link 89.

A calibration unit 70, either connected to or incorporated in the PTE terminal 84, detects the phase and amplitude of the calibration signal 86 transmitted from the antenna 10. Once the sequence of calibration signals have been transmitted, the calibration unit 70 may perform smart data selection on the data points thus-obtained, and determine whether enough data points have been collected for each antenna element 12. If more calibration signals are needed, the calibration unit 70 may send a request to the ground antenna terminal 82 (via the link illustrated by dotted line). In turn, the ground antenna terminal 82 may instruct the ASICs of antenna system 10 to transmit the required calibration signals.

Once the requisite number of data points have been obtained, the calibration unit 70 computes the phase and amplitude adjustments for each antenna element 12, which are then sent to the ground antenna terminal 82. The antenna terminal 82 may then transmit control signals 88 to the antenna system 10 to adjust the phase and amplitude of the antenna elements 12 accordingly.

FIG. 7 shows the embodiment where the phased array antenna 10 operating in a receive system of satellite 80 is being calibrated. The ground antenna terminal 82 may transmit a calibration command 92 to both the antenna system 10 and the PTE terminal 84. In response, the PTE terminal 84 operates as the calibration source by generating and transmitting the sequence of calibration signals to the antenna 10. The antenna elements 12 receive this transmitted signal, causing the ASICs to change the phase of the DDS's on the satellite so as to allow the spaceborne calibration unit to collect the required data, which is then processed by the antenna 10. The processed signal is routed by directional coupler 127 to a calibration unit 70 located in the satellite 80.

After the calibration unit 70 in FIG. 7 measures the power of each received calibration signal, it may execute smart data selection. If the calibration determines that more data points are needed for calibration, it may transmit a request 94 to the ground antenna terminal to instruct the PTE terminal 84 to send more calibration signals. When enough data points are obtained, the calibration unit 70 calculates the amount of phase and amplitude adjustments needed for calibrating each antenna element 12, and instructs the controller to make the necessary adjustments.

While the embodiment shown in FIGS. 6 and 7 describes the ground antenna terminal 82 and PTE terminal 84 as separate entities having specific functions, this description is merely illustrative and should not be construed to so limit the present invention. The functions ascribed to the ground antenna terminal 82 and PTE 84 terminal may be performed by a single terminal, which communicates with the satellite 80 in order to calibrate the antenna elements 12 of phased array antenna 10. Alternatively, one of ordinary skill in the art may contemplate other ways in which the above functions can be divided among the ground antenna terminal 82 and one or more PTE terminals 84.

According to an exemplary embodiment of the present invention, the calibration technique of the present invention may be performed periodically in order to compensate for variances within the components of the phase and amplitude controllers 30, of the phased array antenna system 10. However, in a further exemplary embodiment, calibration may be invoked as a diagnostic measure either in response to reduced or anomalous performance of the antenna 10. Such deviations in performance may be detected according to any type of diagnostic techniques or equipment, as will be contemplated by one of ordinary skill in the art.

The present invention is not intended to be limited to the above described embodiments and applications. It should be noted that the calibration method of the present invention may be used in a wide variety of different configurations and applications encompassing many alternatives, modifications, and variations which are obvious to those ordinarily skilled in the art. For example, the functional blocks in the figures may be implemented in hardware and/or software. The hardware/software implementations may include a combination of processor(s) and article(s) of manufacture. The article(s) of manufacture may further include storage media and executable computer program(s). The executable computer program(s) may include the instructions to perform the described operations. The computer executable program(s) may also be provided as part of externally supplied propagated signal(s). Such variations are not to be regarded as departure from the spirit and scope of the invention, and all such modifications as would be obvious to one skilled in the art are intended to be included within the scope of the following claims.

We claim:

1. A method of calibrating an antenna element, arbitrarily selected from a plurality of such antenna elements, said antenna elements making up a transmit phased array antenna, said method comprising the steps of:

applying a respective one of a plurality of transmit signals, which each initially has the same defined amplitude and phase, to each of the plurality of antenna elements;

maintaining the phase and amplitude of the one of said transmit signals that is applied to the arbitrarily selected antenna element as it is initially, while rotating the phase of the respective transmit signals applied to each of the plurality of antenna elements other than the transmit signal supplied to the arbitrarily selected antenna element, through a sequence of prescribed phase steps;

at each prescribed phase step of said sequence, combining each of the respective transmit signals from each of said plurality of antenna elements with the transmit signal from the arbitrarily selected antenna element in pairwise fashion to produce a plurality of combined signals; and determining a phase error and amplitude error for each of the plurality of antenna elements other than the arbitrarily selected antenna element based on the plurality of combined signals.

2. The method of claim 1, wherein the phase of the transmit signal applied to each of the plurality of antenna elements is rotated using a direct digital synthesizer (DDS) corresponding to each of the plurality of antenna elements.

3. The method of claim 2, wherein said determined phase error and amplitude error is used to adjust the phase and amplitude of said DDS corresponding to each of the plurality of antenna elements.

4. The method of claim 1, wherein said combining of transmit signals includes directing a portion the transmit signal from each of the plurality of antenna elements to a passive power summing unit, as a remainder of the transmit signal from each of the plurality of antenna elements is transmitted.

5. The method of claim 1, further comprising the step of measuring the plurality of combined signals.

6. The method of claim 5, wherein said step of measuring the plurality of combined signals further comprises the step of:

filtering measurements due to anomalies or noise bursts.

7. The method of claim 5, wherein said measuring the plurality of combined signals includes passing each of the plurality of combined signals through a square law power detector and a low-pass filter, to measure the power of each of the plurality of combined signals.

8. The method of claim 7, wherein said pairwise combining includes determining a least squares fit solution for the arbitrary variables $c_1$ $s_1$ and $\xi$ in the matrix expression:

$$\begin{pmatrix} m_1 \\ m_2 \\ \vdots \\ m_N \end{pmatrix} = \begin{pmatrix} \cos\Delta_1 & 1 & \sin\Delta_1 \\ \cos\Delta_2 & 1 & \sin\Delta_2 \\ \vdots & \vdots & \vdots \\ \cos\Delta_N & 1 & \sin\Delta_N \end{pmatrix} \cdot \begin{pmatrix} c_1 \\ \xi \\ s_1 \end{pmatrix}.$$

where $\Delta_{1' \ldots N}$=sequence of prescribed phase values, and $m_{1 \ldots N}$=combined signal measurements, and determining the phase error e of said antenna element being calibrated as $e=\arctan(-s_1\ c_1)$.

9. The method of claim 8, wherein said pairwise combining further includes determining a least squares fit solution for the arbitrary variables $k_1$ and $k_2$ in the matrix expression:

$$\begin{pmatrix} m_1 \\ m_2 \\ \vdots \\ m_N \end{pmatrix} = \begin{pmatrix} 1 & \cos(\Delta_1 + \hat{e}) \\ 1 & \cos(\Delta_2 + \hat{e}) \\ \vdots & \vdots \\ 1 & \cos(\Delta_N + \hat{e}) \end{pmatrix} \cdot \begin{pmatrix} k_1 \\ k_2 \end{pmatrix}$$

and solving the equation:

$$a_{1,2} = \frac{k_1}{k_2} \pm \sqrt{\left(\frac{k_1}{k_2}\right)^2 - 1}$$

wherein $\hat{e}$ is an estimate of e and either the value of $a_1$ or $a_2$ is determined to be the ratio of the signal amplitude of the one of the plurality of antenna elements to the signal amplitude of the arbitrarily selected reference element, based on whether the transmit power of the one of the plurality of antenna elements is greater than or less than the transmit power of the arbitrarily selected reference element.

10. The method of claim 9, wherein when said transmit power of the one of the plurality of antenna elements is less than said transmit power of the arbitrarily selected reference element, said ratio is determined to be the value of $a_1$ or $a_2$ which is less than one and when said transmit power of the one of the plurality of antenna elements is greater than said transmit power of the arbitrarily selected reference element, said ratio is determined to be the value of $a_1$ or $a_2$ which is greater than one.

11. A method of calibrating an antenna element, arbitrarily selected from a plurality of such antenna elements, said antenna elements making up a receive phased array antenna, said method comprising the steps of:

applying a respective one of a plurality of receive signals, which each initially has the same defined amplitude and phase, to each of the plurality of antenna elements;

maintaining the phase and amplitude of the one of said receive signals that is applied to the arbitrarily selected antenna element as it is initially, while rotating the phase of the respective receive signals applied to each of the plurality of antenna elements, other than the receive signal supplied to the arbitrarily selected antenna element, through a sequence of prescribed phase steps;

at each prescribed phase step of said sequence, combining each of the receive signals from each of said plurality of antenna elements with the receive signal from the arbitrarily selected reference element in pairwise fashion to produce a plurality of combined signals; and determining a phase error and amplitude error for each of the plurality of antenna elements based on the plurality of combined signals.

12. The method of claim 11, wherein said phase of the receive signal applied to each of said antenna elements is rotated using a direct digital synthesizer (DDS) corresponding to each of the plurality of antenna elements.

13. The method of claim 11, wherein the phase of the receive signal applied to each of the plurality of antenna elements is rotated using a direct digital synthesizer (DDS) corresponding to each of the plurality of antenna elements.

14. The method of claim 11, further comprising the step of measuring the plurality of combined signals.

15. The method of claim 14, wherein said step of measuring the plurality of combined signals further comprises the step of:

filtering measurements due to anomalies or noise bursts.

16. The method of claim 14, wherein said measuring the plurality of combined signals includes passing each of the plurality of combined signals through a square law power detector and a low-pass filter, to measure the power of each of the plurality of combined signals.

17. The method of claim 16, wherein said pairwise combining includes determining a least squares fit solution for the arbitrary variables $c_1$, $s_1$, and $\xi$ in the matrix expression:

$$\begin{pmatrix} m_1 \\ m_2 \\ \vdots \\ m_N \end{pmatrix} = \begin{pmatrix} \cos\Delta_1 & 1 & \sin\Delta_1 \\ \cos\Delta_2 & 1 & \sin\Delta_2 \\ \vdots & \vdots & \vdots \\ \cos\Delta_N & 1 & \sin\Delta_N \end{pmatrix} \cdot \begin{pmatrix} c_1 \\ \xi \\ s_1 \end{pmatrix}$$

where $\Delta_{1 \ldots N}$=sequence of prescribed phase values, and $m_{1 \ldots N}$=combined signal measurements, and determining the phase error e of said antenna element being calibrated as $e=\arctan(-s_1\ c_1)$.

18. The method of claim 17, wherein said pairwise combining further includes determining a least squares fit solution for the arbitrary variables $k_1$ and $k_2$ in the matrix expression:

$$\begin{pmatrix} m_1 \\ m_2 \\ \vdots \\ m_N \end{pmatrix} = \begin{pmatrix} 1 & \cos(\Delta_1 + \hat{e}) \\ 1 & \cos(\Delta_2 + \hat{e}) \\ \vdots & \vdots \\ 1 & \cos(\Delta_N + \hat{e}) \end{pmatrix} \cdot \begin{pmatrix} k_1 \\ k_2 \end{pmatrix}$$

and solving the equation:

$$a_{1,2} = \frac{k_1}{k_2} \pm \sqrt{\left(\frac{k_1}{k_2}\right)^2 - 1}$$

wherein $\hat{e}$ is an estimate of e and either the value of $a_1$ or $a_2$ is determined to be the ratio of the signal amplitude of the one of the plurality of antenna elements to the signal amplitude of the arbitrarily selected reference element, based on whether the transmit power of the one of the plurality of antenna elements is greater than or less than the transmit power of the arbitrarily selected reference element.

19. The method of claim 18, wherein when said receive power of the one of the plurality of antenna elements is less than said receive power of the arbitrarily selected reference element, said ratio is determined to be the value of $a_1$ or $a_2$ which is less than one and when said receive power of the one of the plurality of antenna elements is greater than said receive power of the arbitrarily selected reference element, said ratio is determined to be the value of $a_1$ or $a_2$ which is greater than one.

20. A controller for calibrating an antenna element, arbitrarily selected from a plurality of such antenna elements, said antenna elements making up a transmit phased array antenna, said controller comprising:

a phase and amplitude controller that maintains a phase and amplitude of a transmit signal that is applied to the arbitrarily selected antenna element as it is initially, while rotating a phase of transmit signals applied to each of the plurality of antenna elements, other than the transmit signal supplied to the arbitrarily selected antenna element, through a sequence of prescribed phase steps;

a combiner that combines each of the transmit signals from each of said plurality of antenna elements with the transmit signal from arbitrarily selected antenna element, at each prescribed phase step of said sequence, in pairwise fashion, thereby producing a plurality of combined signals; and a calibration unit that determines a phase error and amplitude error for each of the plurality of antenna elements other than the arbitrarily selected antenna element based on the plurality of combined signals.

21. A transmit system including the controller of claim 20.

22. A controller for calibrating an antenna element, arbitrarily selected from a plurality of such antenna elements, said antenna elements making up a receive phased array antenna, said controller comprising:

a phase and amplitude controller for maintaining a phase and amplitude of a receive signal that is applied to the arbitrarily selected antenna element as it is initially, while rotating a phase of receive signals applied to each of the plurality of antenna elements other than the receive signal supplied to the arbitrarily selected antenna element through a sequence of prescribed phase steps;

a combiner for combining each of the receive signals from each of said plurality of antenna elements with the receive signal from arbitrarily selected antenna element, at each prescribed phase step of said sequence, in pairwise fashion to produce a plurality of combined signals; and a calibration unit for determining a phase error and amplitude error for each of the plurality of antenna elements other than the arbitrarily selected antenna element based on the plurality of combined signals.

23. A receive system including the controller of claim 22.

24. A controller for calibrating an antenna element, arbitrarily selected from a plurality of such antenna elements, said antenna elements making up a transmit phased array antenna, said controller comprising:

phase and amplitude control means for maintaining the phase and amplitude of a transmit signal that is applied to the arbitrarily selected antenna element as it is initially, while rotating a phase of transmit signals applied to each of the plurality of antenna elements, other than the transmit signal supplied to the arbitrarily selected antenna element, through a sequence of prescribed phase steps;

combining means for combining each of the transmit signals from each of said plurality of antenna elements with the transmit signal from the arbitrarily selected antenna element, at each prescribed phase step of said sequence, in pairwise fashion to produce a plurality of combined signals; and calibration means for determining a phase error and amplitude error for each of the plurality of antenna elements other than the arbitrarily selected antenna element based on the plurality of combined signals.

25. A transmit system including the controller of claim 24.

26. A controller for calibrating an antenna element, arbitrarily selected from a plurality of such antenna elements, said antenna elements making up a receive phased array antenna, said controller comprising:

phase and amplitude control means for maintaining a phase and amplitude of a receive signal that is applied to the arbitrarily selected antenna element as it is initially, while rotating a phase of receive signals applied to each of the plurality of antenna elements, other than the receive signal supplied to the arbitrarily selected antenna element, through a sequence of prescribed phase steps;

combining means for combining each of the receive signals from each of said plurality of antenna elements with the receive signal from the arbitrarily selected antenna element, at each prescribed phase step of said sequence, in pairwise fashion to produce a plurality of combined signals; and calibration means for determining a phase error and amplitude error for each of the plurality of antenna elements other than the arbitrarily selected antenna element based on the plurality of combined signals.

27. A receive system including the controller of claim 26.

28. A computer program embodiment on a medium, said computer program causing a processor to calibrate an antenna element arbitrarily selected from a plurality of such antenna elements, said antenna elements making up a phased array antenna, said computer program comprising:

a phase rotating segment means for maintaining a phase and amplitude of a signal that is applied to the arbitrarily selected antenna element as it is initially, while rotating a phase of signals applied to each of the plurality of antenna elements, other than the signal supplied to the arbitrarily selected antenna element, through a sequence of prescribed phase steps;

a combining code segment means for combining, at each prescribed phase step of said sequence, each of the signals from each of said plurality of antenna elements with the signal from the arbitrarily selected antenna element in pairwise fashion to produce a plurality of combined signals; and a determining code segment means for determining a phase error and amplitude error for each of the plurality of antenna elements other than the arbitrarily selected antenna element based on the plurality of combined signals.

29. The computer program of claim 28, wherein the signals are one of transmit and receive signals.

* * * * *